US005375764A

United States Patent [19]

Sauerwine

[11] Patent Number: 5,375,764

[45] Date of Patent: Dec. 27, 1994

[54] DOUBLE PARALLEL HEAT SEAL MAILER

[75] Inventor: Dean N. Sauerwine, Emmaus, Pa.

[73] Assignee: Moore Business Forms, Inc., Grand Island, N.Y.

[21] Appl. No.: 47,209

[22] Filed: Apr. 16, 1993

[51] Int. Cl.[5] ..... B65D 27/04; B65D 27/06

[52] U.S. Cl. ..... 229/304; 229/97.3

[58] Field of Search ..... 229/304, 305, 92.1, 229/92.3

[56] References Cited

U.S. PATENT DOCUMENTS

| | | | |
|---|---|---|---|
| 2,759,658 | 8/1956 | Sawdon | 229/305 |
| 3,143,279 | 8/1964 | Black | 229/73 |
| 3,184,150 | 5/1965 | Hubbard | 229/73 |
| 3,197,121 | 7/1965 | Hayes, Jr. | 229/92.1 |
| 3,228,586 | 1/1966 | Hayes, Jr. | 229/73 |
| 3,255,952 | 6/1966 | Black | 229/73 |
| 3,507,519 | 4/1970 | McNabb | 229/305 |
| 3,652,007 | 3/1972 | MacDougall | 229/73 |
| 3,946,938 | 3/1976 | Kranz | 229/73 |
| 3,995,808 | 12/1976 | Kehoe | 229/305 |
| 4,044,942 | 8/1977 | Sherwood | 229/305 |
| 4,575,121 | 3/1986 | Conti | 281/2 |
| 4,706,878 | 11/1987 | Lubotta et al. | 229/304 |
| 4,799,618 | 1/1989 | Jenkins | 229/92.3 |
| 5,193,850 | 3/1993 | Lombardo . | |
| 5,201,464 | 4/1993 | File . | |

*Primary Examiner*—Stephen P. Garbe

*Attorney, Agent, or Firm*—Nixon & Vanderhye

[57] ABSTRACT

A mailer type business form is formed by double parallel folding a single sheet of paper. The mailer may include a return envelope with a side opening edge, or it may comprise a seven page booklet, all of the pages attached together at one edge and most or all of the pages detachable from the booklet along a perforation line. One of the panels may be of a somewhat smaller width than the others, to allow elimination of one adhesive line, and one thickness of the final mailer, when the intermediate is double parallel folded.

14 Claims, 11 Drawing Sheets

DOUBLE PARALLEL HEAT SEAL MAILER

BACKGROUND AND SUMMARY OF THE INVENTION

It is highly desirable to be able to construct mailer type business forms in a simple and effective manner. One particularly desirable manner of construction is to provide double parallel folding of a single sheet of paper. According to the present invention, a mailer type business form may be constructed by double parallel folding of a single sheet of paper with various glue lines and perforations being provided so as to produce a return envelope having a side opening feature, or to produce a seven page booklet. Both types mailers according to the invention can be produced from a 9½ inch by 17 inch sheet of paper, which can be run during manufacture on a 9½ inch×8½ pad for easier folding and handling.

According to a first aspect of the present invention, an intermediate for a mailer type business form having a return envelope, is provided. The return envelope produced from the intermediate is side-opening, and is large enough to easily enclose a personal check. The intermediate according to this aspect of the present invention comprises the following elements: A quadrate single sheet of paper having first and second faces, first and second parallel side edges, and first and second parallel end edges. First, second and third fold lines parallel to the end edges, and dividing the sheet into first through fourth essentially equal sized panels, the first panel between the first end edge and the first fold line, the second panel between the first and second fold lines, the third panel between the second and third lines, and the fourth panel between the third fold line and the second end edge. A first adhesive pattern formed on one of the second and third panels first face for cooperating with the other of the second and third panels to form a return envelope when the sheet is double parallel folded about the fold lines. A flap fold line provided in one of the second and third panels adjacent the first adhesive pattern, and parallel to the side edges, defining a fold-over flap for a return envelope formed when the sheet is double parallel folded about the fold lines. An activatable adhesive pattern disposed on the flap first face. A reply address area provided on the second face of one of the second or third panels. A second adhesive pattern formed on the first face of the fourth panel, and a third adhesive pattern formed on the second face of the first panel for holding the panels together when the sheet is double parallel folded about the fold lines. And, lines of weakness formed in the panels adjacent the second and third adhesive panels for allowing detachment of the sheet thereat to allow opening of a mailer formed by double parallel folding the sheet about the fold lines.

The intermediate preferably also comprises an outgoing address provided on the first panel first face, with a window in the fourth panel, the window in alignment with the outgoing address area when the sheet is double parallel folded about the fold lines to form a mailer. The first adhesive pattern may comprise a generally U-shaped pattern comprising three strips, first and second strips adjacent and parallel to two of the fold lines, and a third strip adjacent and parallel to the side edge on the opposite side of the sheet from the flap. A fourth adhesive pattern is also typically provided, comprising a pair of strips of adhesive on the first face adjacent the first and second side edges, respectively, on one of the second and third panels, and lines of weakness on the opposite side of the fourth adhesive pattern strips from their respective side edges. The first through fourth adhesive patterns may be heat activated adhesive (or pressure activated cohesive, or the like), and the activatable adhesive pattern on the flap is preferably rewettable adhesive (or pressure sensitive adhesive covered by a release strip). Further a line of weakness comprising an extension of the flap fold line is formed in the one of the second and third panels in which the flap fold line is not formed, to readily expose the activatable adhesive when the mailer is opened.

The mailer produced from the intermediate described above has the following components: First, second, third and fourth substantially quadrate panels, each having essentially the same size, first and second side edges, and first and second end edges, and top and bottom faces. (The first panel underlies the fourth panel, and the second panel underlies the first panel, and the third panel underlies the second panel.) A first adhesive pattern comprising first and second strips of adhesive parallel to and adjacent, but spaced from, the end edges, and a third strip of adhesive parallel to and adjacent, but spaced from, the first side edge, the strips acting between the second panel top face and the third panel bottom face to define a return envelope. A flap fold line formed in one of the second and third panels, and a stub-forming line of weakness formed in the other of the second and third panels, the flap fold line and the stub-forming line of weakness in alignment with each other and adjacent, but spaced from, and parallel to, the second side edge, the flap fold line forming a return envelope flap. A strip of activatable adhesive provided on the face of the flap facing the second panel if the flap is formed in the third panel, or facing the third panel if the flap is formed in the second panel. Reply address indicia provided on the reply envelope. Second and third adhesive patterns holding the first panel to the fourth panel adjacent at least one end edge thereof, and for holding the first panel to the second panel adjacent at least one end edge thereof. And, lines of weakness formed in at least the first, fourth and second panels adjacent the second and third adhesive patterns on the opposite sides thereof from the adjacent end edges, to facilitate opening of the mailer.

According to another aspect of the present invention an intermediate for a mailer type business form that may be used to provide a return envelope construction, or a seven page booklet construction, is formed into a mailer by eccentric double parallel folding. The intermediate comprises the following elements: A quadrate single sheet of paper having first and second faces, first and second parallel side edges, and first and second parallel end edges. First, second, and third fold lines provided in the sheet parallel to the end edges; the spacing between the first and second fold lines, the spacing between the second and third fold lines, and the spacing between the third fold line and the second end edge being equal, and significantly greater than the spacing of the first fold line from the first end edge. The fold lines defining the sheet into first through fourth panels, the first panel between the first end edge and the first fold line, the second panel between the first and second fold lines, the third panel between the second and third fold lines, and the fourth panel between the third fold line and the second end edge. A first strip of adhesive formed on the first face of the fourth panel immediately adjacent the second end edge, so that when the sheet is double parallel folded about the fold lines, the first strip engages the second panel second face, and does not engage the first panel. And, an outgoing address area visible on the second face of the fourth panel.

The intermediate described above also preferably has a window in the fourth panel and the outgoing address area is formed on the first panel first face so that when the sheet is double parallel folded about the fold lines the outgoing address area is visible through the window. If the intermediate is to be formed into a seven page booklet configuration, a second strip of adhesive is disposed on the first face of the second panel immediately adjacent and parallel to the first fold line for holding the second and third panels together thereat when the sheet is double parallel folded about the fold lines, and all of the fold lines may comprise lines of weakness.

The invention also comprises a mailer constructed from the intermediate described above. The mailer comprises the following elements: First, second, third and fourth substantially quadrate panels, each having first and second side edges, and first and second end edges, and top and bottom faces. The first panel underlies the fourth panel, and the second panel underlies the first panel, and the third panel underlies the second panel. (The first panel has a dimension along the side edges a significant amount less than the second through fourth panels, while the second through fourth panels have essentially the same size, and the first panel has a dimension along the end edges the same as the dimension along the end edges of the second through fourth panels.) A first strip of adhesive connecting the bottom face of the fourth panel to the top face of the second panel at the first end edge of each. A line of weakness formed in each of the fourth, second, and third panels immediately adjacent and parallel to the first strip of adhesive on the opposite side thereof as the first end edge of each, the first end edge of the first panel substantially in alignment with the lines of weakness in the fourth, second, and third panels. And, outgoing address indicia visible by viewing the top face of the fourth panel.

In the seven page booklet embodiment of the mailer, where a second strip of adhesive connects the second and third panels together and extends immediately adjacent and parallel to the second end edge of each, the following indicia may be on the indicated faces of the indicated panels:

| panel/face | indicia |
|---|---|
| fourth panel, bottom face | page 1 |
| third panel, top face | page 6 |
| second panel, bottom face | page 5 |
| first panel, top face | page 2 |
| third panel, bottom face | page 7 |
| second panel, top face | page 4 |
| first panel, bottom face | page 3. |

Rather than formed from an eccentrically double parallel folded single sheet of paper, the mailer according to the present invention, in which a seven page booklet embodiment is provided after opening the mailer, may be formed by standard double parallel folding. The intermediate for constructing this mailer comprises the following elements: A quadrate single sheet of paper having first and second faces, first and second parallel side edges, and first and second parallel end edges. First, second, and third fold lines provided in the sheet parallel to the end edges, the fold lines defining the sheet into first through fourth substantially identically sized panels, the first panel between the first end edge and the first fold line, the second panel between the first and second fold lines, the third panel between the second and third fold lines, and the fourth panel between the third fold line and the second end edge. A first strip of adhesive disposed on the first face of the fourth panel, immediately adjacent and parallel to the second end edge of the sheet. A second strip of adhesive disposed on the second face of the first panel, immediately adjacent and parallel to the first end edge of the sheet. First and second lines of weakness formed in the first and fourth panels adjacent and parallel to the first and second strips of adhesive on the opposite side thereof from the second and first end edges, respectively, and third and fourth lines of weakness formed in the second and third panels, respectively, in alignment with the first and second lines of weakness when the sheet is double parallel folded about the fold lines (the second fold line comprises a line of weakness). A third strip of adhesive disposed on the first face of the second panel immediately adjacent and parallel to the first fold line for holding the second and third panels together thereat when the sheet is double parallel folded about the fold lines. And, an outgoing address area visible on the second face of the fourth panel.

In the intermediate described above, the following indicia may be provided on the indicated faces of the indicated panels:

| panel/face | indicia |
|---|---|
| fourth panel, first face | page 1 |
| third panel, first face | page 6 |
| second panel, first face | page 5 |
| first panel, first face | page 2 |
| third panel, second face | page 7 |
| second panel, second face | page 4 |
| first panel, second face | page 3. |

The mailer constructed from the intermediate described above has the following elements: First, second, third and fourth substantially quadrate and equal size panels, each having first and second side edges, and first and second end edges, and top and bottom faces. (The first panel underlies the fourth panel, the second panel underlies the first panel, and the third panel underlies the second panel.) A first strip of adhesive connecting the bottom face of the fourth panel to the top face of the first panel, and a second strip of adhesive connecting the bottom face of the first panel to the top face of the second panel at the first end edge of each. A third strip of adhesive connecting the second and third panels together and extending immediately adjacent and parallel to the second end edge of each. A line of weakness formed in each of the first through fourth panels immediately adjacent and parallel to the first and second strips of adhesive on the opposite side thereof as the first end edge of each. And, outgoing address indicia visible by viewing the top face of the fourth panel.

In general, the invention also contemplates an intermediate for a mailer type business form that is constructed into a seven page booklet when the mailer is opened. The intermediate comprises: A quadrate single sheet of paper having first and second faces, first and second parallel side edges, and first and second parallel end edges. First, second, and third fold lines provided in the sheet parallel to the end edges, the fold lines defining the sheet into first through fourth panels, the first panel between the first end edge and the first fold line, the second panel between the first and second fold lines, the third panel between the second and third fold lines, and the fourth panel between the third fold line and the second end edge. A first strip of adhesive disposed on the first face of the fourth panel, immediately adjacent and parallel to the second end edge of the sheet. A first line of weakness formed in the fourth panel adjacent and parallel to the first strip of adhesive on the opposite side thereof from the second end edge, and at least second and third lines of weakness formed in the second and third panels, respectively, in alignment with the first line of weakness when the sheet is double parallel folded about the fold lines (the second fold line comprises a line of weakness). A second strip of adhesive disposed on the first face of the second panel immediately adjacent and parallel to the first fold line for holding the second and third panels together thereat when the sheet is double parallel folded about the fold lines. And, an outgoing address area visible on the second face of the fourth panel.

The mailer constructed from the intermediate described above comprises the following elements: First, second, third and fourth substantially quadrate panels each having first and second side edges, and first and second end edges, and top and bottom faces; the first panel underlying the fourth panel, the second panel underlying the first panel, and the third panel inderlying the second panel. A first strip of adhesive connecting the bottom face of the fourth panel to the top face of one of the first and second panels. A line of weakness formed in at least each of the second through fourth panels immediately adjacent and parallel to the first strip of adhesive on the opposite side thereof from the first end edge of each. A second strip of adhesive connecting the second and third panels together and extending immediately adjacent and parallel to the second end edge of each. And, outgoing address indicia visible by viewing the top face of the fourth panel.

It is the primary object of the present invention to provide a mailer that may be constructed by double parallel folding a single sheet of paper, which may either include a return envelope, or may form a seven page booklet when opened. This and other objects of the invention will become clear from an inspection of the detailed description of the invention, and from the appended claims.

DETAILED DESCRIPTION OF THE DRAWINGS

Figure 1:
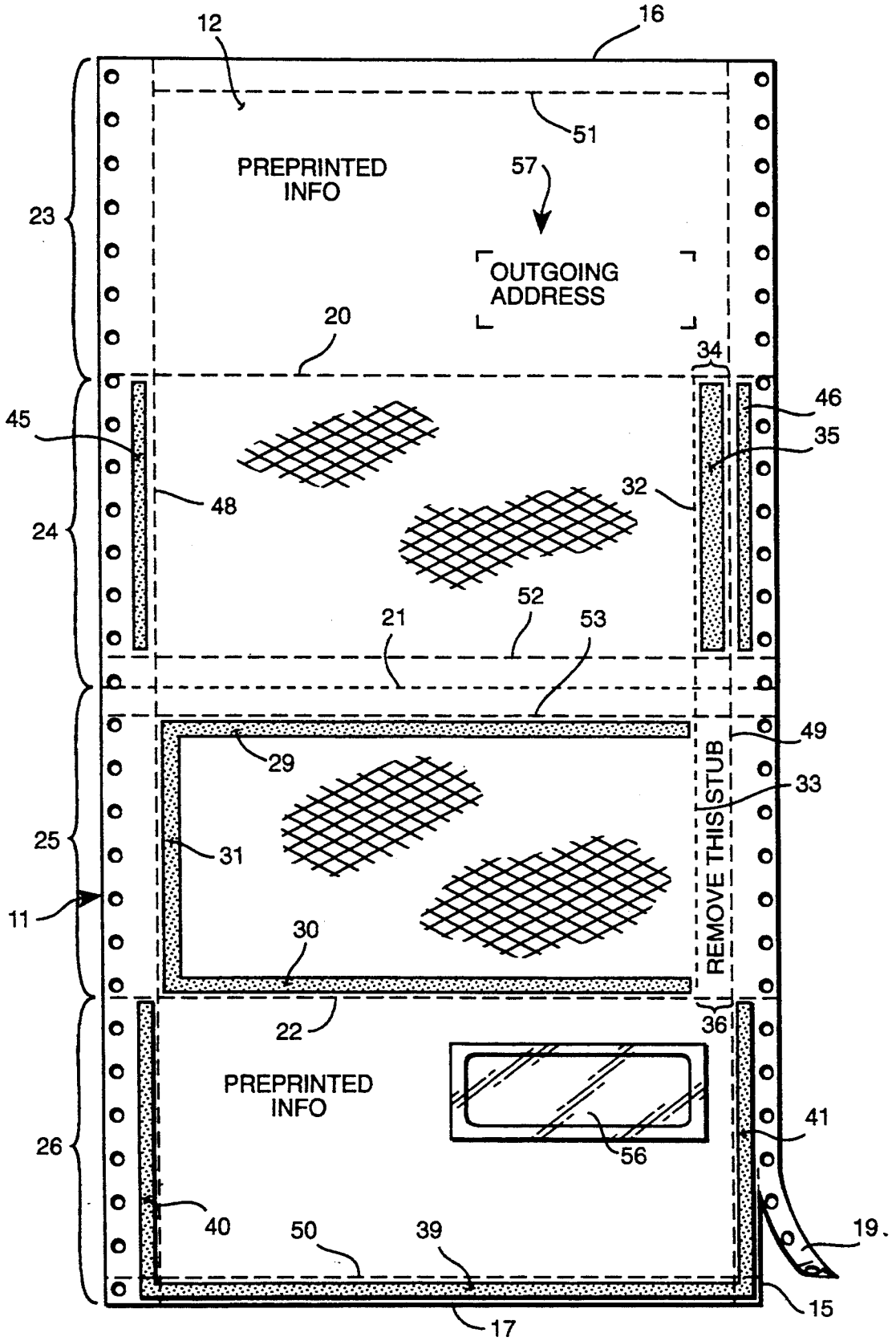
FIG. 1 is a top plan view of a first embodiment of an exemplary intermediate according to the present invention.
Figure 2:
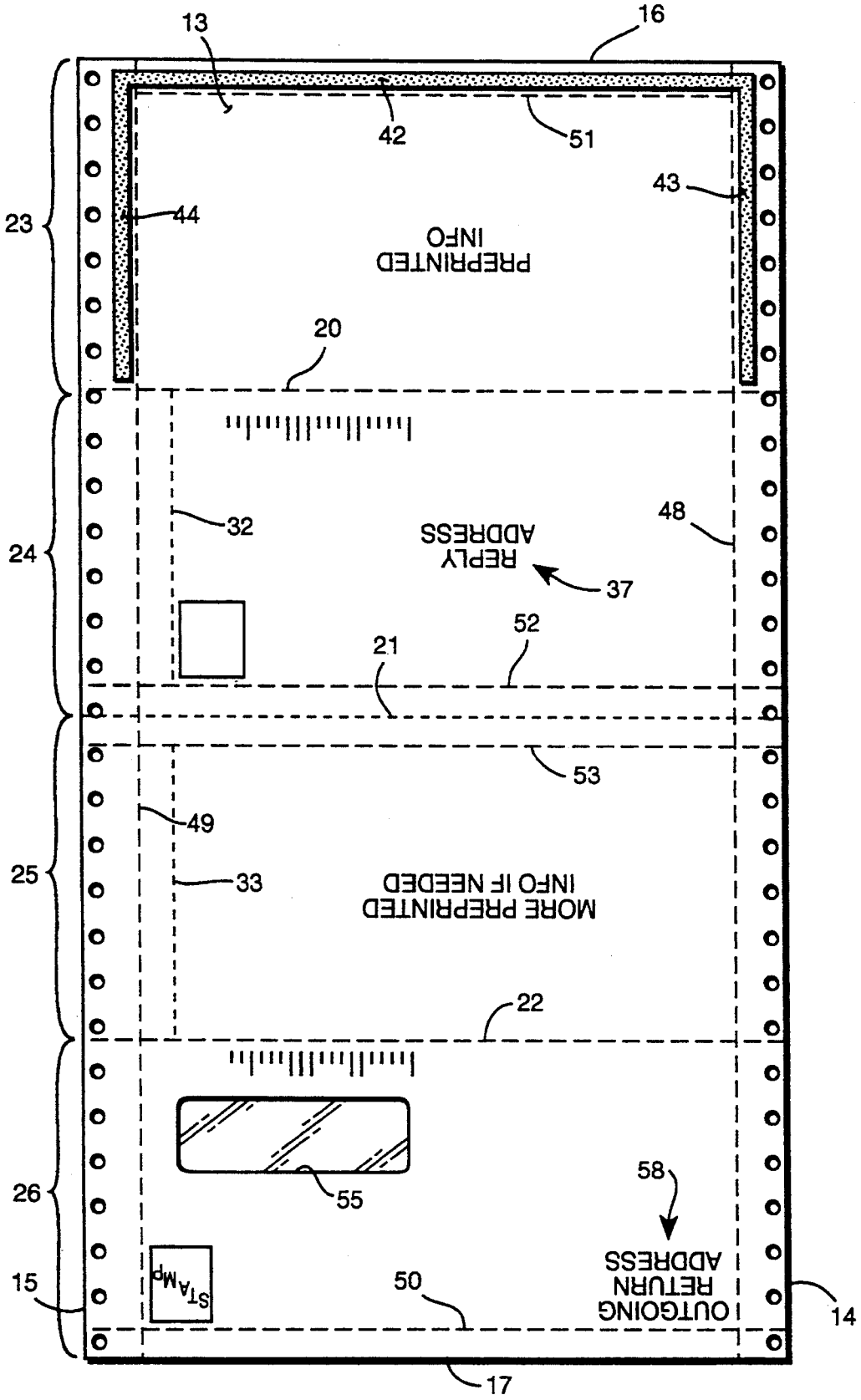
FIG. 2 is a bottom plan view of the intermediate of FIG. 1.

A first embodiment of the present invention is illustrated in FIGS. 1 through 6. In this embodiment, a mailer—shown generally by reference numeral 10 in FIG. 4—is constructed from an intermediate 11—seen most clearly in FIGS. 1 through 3. The intermediate comprises a quadrate single sheet of paper, typically 9½ inches by 17 inches, having a first face 12 and a second face 13 (see FIGS. 1 and 2, respectively), first and second parallel side edges 14, 15, respectively, and first and second parallel end edges 16, 17, respectively. As seen in FIG. 1, typically the sheet 11 is formed with tractor drive strips (see strip 19) along both sides thereof, however the strips 19 are cut off by a conventional slitting mechanism (in the preferred form) prior to final mailer construction. FIG. 1 illustrates the sheet forming the intermediate 11 with the tractor drive openings before slitting off strips 19, while FIG. 2 shows the intermediate 11 after the tractor drive opening strips 19 have been slit off and the final edges 14, 15 defined. The sheet 11 also may be in continuous form, that is connected to like sheets at the edges 16, 17 thereof (which define perforation lines), not shown in the drawings.

The intermediate 11 also comprises first, second, and third fold lines 20, 21, and 22, respectively, which are parallel to the end edges 16, 17, and which either may be creases, or lines of weakness such as perforation lines. The fold lines 20–22 define the intermediate 11 into first, second, third, and fourth panels of substantially the same size. The panels are shown by reference numerals 23 through 26, respectively, in FIGS. 1 and 2. The first panel 23 is between the first fold line 20 and the first end edge 16, the second panel 24 between the first and second fold lines 20, 21, the third panel 25 between the second and third fold lines 21, 22, and the fourth panel 26 between the third fold line 22 and the second end edge 17.

The intermediate 11 also comprises a first adhesive pattern formed on one of the second and third panels 24, 25 for cooperating with the other of those panels to form a return envelope 28 (see FIGS. 5 and 6) when the sheet 11 is double parallel folded about the fold lines 20–22. In the exemplary embodiment illustrated in FIG. 1, the first adhesive pattern comprises strips 29, 30 formed on the first face 12 of third panel 25, and a third strip 31 transverse to the strips 29, 30. The strips 29, 30 are parallel to and adjacent, but spaced from, the fold lines 21, 22, while the strip 31 is adjacent, though spaced from, the first side edge 14. The adhesive strips 29–31 can be a wide variety of different types of permanent adhesive, but preferably are heat activated adhesive.

The intermediate 11 also comprises a flap fold line 32, in one of the second or third panels 24, 25 (the second panel 24 in the embodiment illustrated in the drawings), which may be a crease or a perforation, or the like, which is parallel to the side edges 14, 15 and adjacent the first adhesive pattern 29–31 when the sheet 11 is double parallel folded. The sheet 11 also preferably comprises a line of weakness 33 comprising an extension of the flap fold line 32. The line of weakness 33 is formed in the third panel 25 if the flap fold line is formed in the second panel 24, and vice versa. Disposed on the first face 12 of the flap portion 34 formed by the flap fold line 32 is an activatable adhesive pattern (strip) 35 (see FIG. 1) on the first face 12 thereof. The adhesive 35 may be rewettable adhesive, or pressure sensitive adhesive covered by a release strip. The flap portion 34 has approximately the same dimensions as the removable stub 36 formed in the third panel 25.

The reply envelope 28 also comprises reply address indicia (in both human and machine readable form) 37 (see FIGS. 2 and 6) formed on the second face 11 of one of the panels 24, 25, preferably on the second face 13 of the second panel 24 as illustrated in FIG. 2.

The intermediate 11 also comprises a second adhesive pattern formed on the first face 12 of the fourth panel 26, and a third adhesive pattern formed on the second face 13 of the first panel 23, for holding the panels 23–26 together when the sheet 11 is double parallel folded about the fold lines 20–22. In the exemplary embodiment illustrated in FIGS. 1 and 2, the second adhesive pattern comprises a strip 39 adjacent and parallel to the second end edge 17, and side strips 40, 41 adjacent and parallel to the side edges 14, 15, respectively. A second adhesive pattern 39–41 preferably also comprises heat activatable adhesive, the same type of adhesive as for the pattern 29–31. Similarly, as seen in FIG. 2, the third adhesive pattern preferably comprises the end strip 42 adjacent and parallel to the first end edge 16, and the side strips 43, 44, adjacent and parallel to the side edges 14, 15, respectively. The adhesive of the pattern 42–44 is the same as that of the patterns 39–41, and 29–31.

In order to provide even more secure holding of the mailer 10 in its final configuration, preferably a fourth adhesive pattern, defined by—in the exemplary embodiment illustrated in FIG. 1—the strips of adhesive 45, 46 adjacent and parallel to side edges 14, 15, respectively, is provided on the first face 12 of the second panel 24 (or on the third panel 25 in the same positions, if desired). The adhesive of the fourth pattern 45–46 is the same as that of the other patterns (e.g. 29–31).

In order to facilitate opening of the mailer, held together by the patterns 29–31, and 39–46, lines of weakness are formed in the panels 23–26 adjacent the second, third, and fourth adhesive patterns 40–46. For example the line of weakness 48 which is parallel to the first side edge 14 and on the opposite side of the adhesive strips 40, 45 from the side edge 14, and extends through all of the panels 23 through 26. A comparable line of weakness 49 is disposed adjacent the side edge 15, lines of weakness 50, 51 are also provided adjacent and parallel to the end edges 17, 16, respectively, and on the opposite sides thereof from the adhesive strips 39, 42, respectively. When the sheet 11 is double parallel folded about the fold lines 20–22, the: lines of weakness 52, 53 formed in the second and third panels 24, 25, respectively, are in alignment with the lines of weakness 50, 51. Note that all of these lines of weakness 50–53, which are parallel to the end edges 16, 17, do not extend all the way to the side edges 14, 3.5, but rather terminate in the side lines of weakness 48, 49. This configuration is provided in order to ensure that the mailer 10 is opened at the sides first before it is opened at the top.

While it is preferred that the side strips of adhesive 40, 41, 43, 44, 45, and 46 be provided, under some circumstances only the end strips 39, 42, are provided, and still provide the final mailer 10 with integrity, although not as secure as if the strips 40, 41, etc. are provided.

Figure 4:
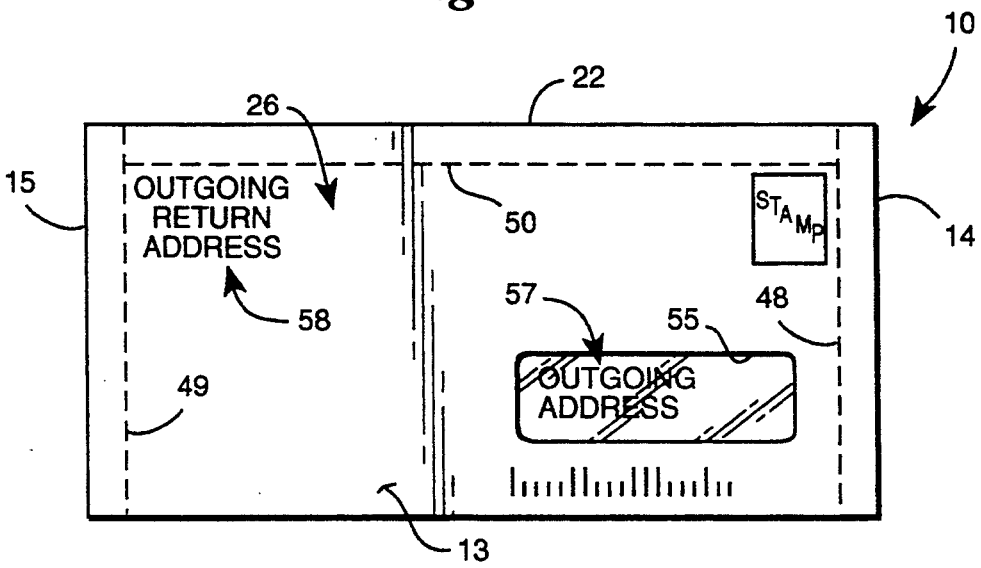
FIG. 4 is a front plan view of the mailer constructed from the intermediate of FIGS. 1 through 3.

The intermediate 11 also preferably comprises an outgoing address area, so that the outgoing address is visible when looking down on the second face 13 of the fourth panel 26 in the final mailer 10 construction (see FIG. 4). This may be provided by printing the outgoing address on the second face 13 of the fourth panel 26, or—in the preferred embodiment illustrated in FIGS. 1, 2, and 4—a cut out 55 covered by a glassine patch 56 is provided in the fourth panel 26, in alignment with the outgoing address indicia 57 printed on the first face 12 of the first panel 23 so that the address 57 is readable through the glassine patch 56 in the window 55, as seen in FIG. 4. Outgoing return address indicia 58 is preferably printed on the second face 13 of the fourth panel 26.

The intermediate 11 may be formed into the final mailer 10 on a Moore Business Forms, Inc. 8121 folder nester, which provides a double parallel fold, and then heat seals the adhesive strips 29–31 and 39–46. The first folding takes place about second fold line 21, causing the fold faces 12 of the panels 23, 26 to come into contact, and the first faces 12 of the panels 24, 25 to come into contact. Then the second folding takes place about the Lines 20, 22, causing the final mailer 10 to comprise the fourth panel 26 on top, then the first panel 23, then the second panel 24, then the third panel 25, the second face 13 of the third panel 25 comprising the rear of the mailer (not seen in FIG. 4). The second adhesive pattern 39–41 holds the panels 26, 23 together, while the third adhesive pattern 42–44 holds the panels 24, 23 together, and the fourth adhesive pattern 45, 46 holds the second and third panels 24, 25 together. If desired, additional heat sealable adhesive could be provided in the areas bounded by the second fold line 21 and one or both of the lines of weakness 52, 53, but typically such adhesive is not necessary.

Figure 3:
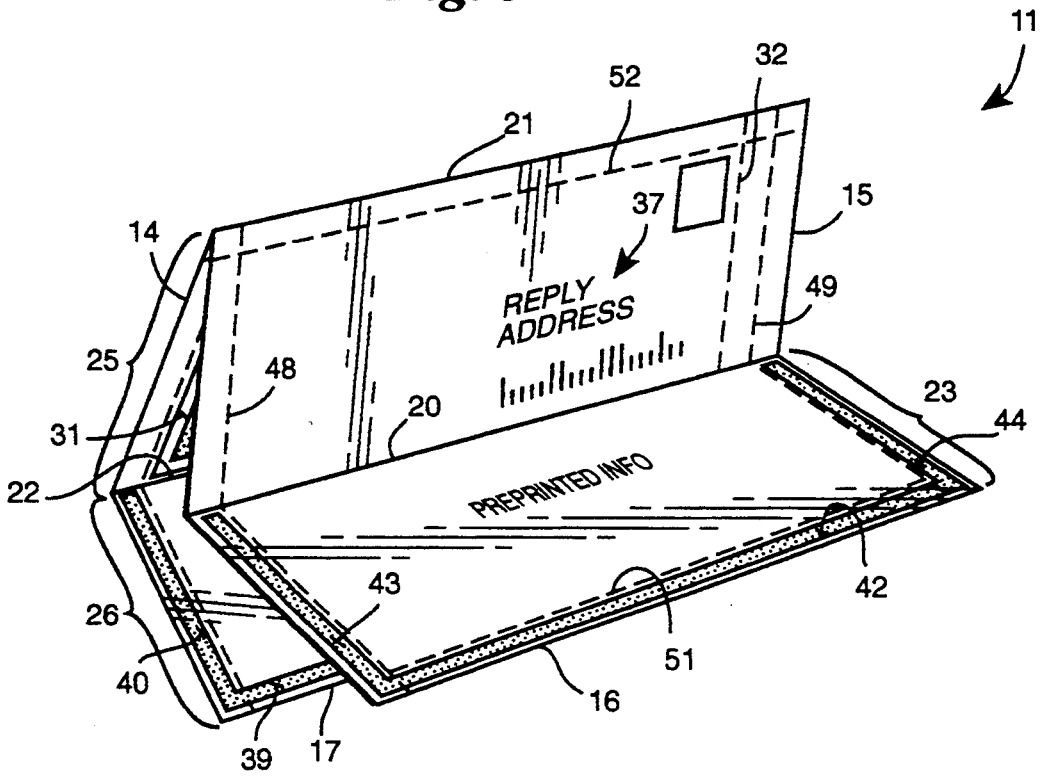
FIG. 3 is a top perspective view illustrating double parallel folding of the intermediate of FIGS. 1 and 2.
Figure 5:
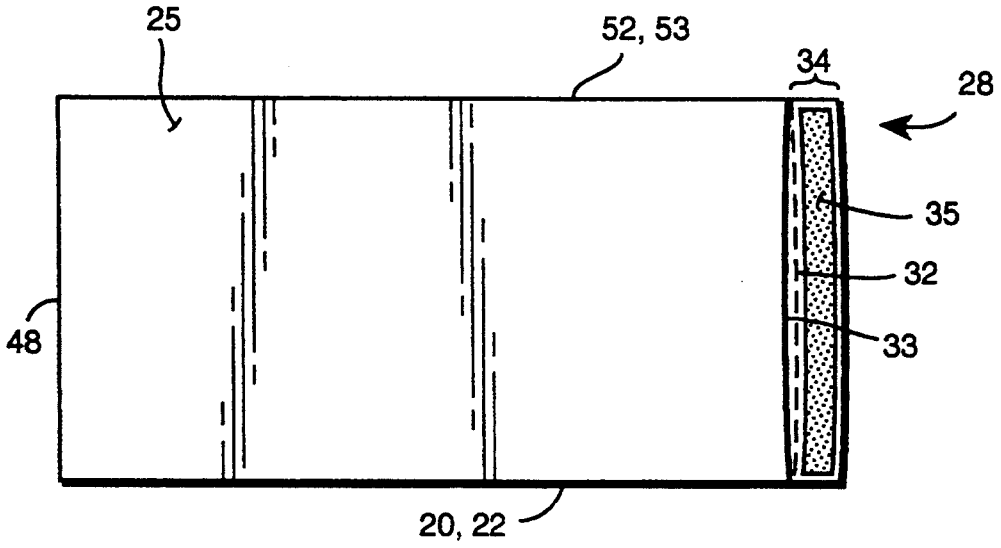
FIG. 5 is a rear perspective view of the return envelope formed by opening up the mailer of FIG. 4 and detaching the components.
Figure 6:
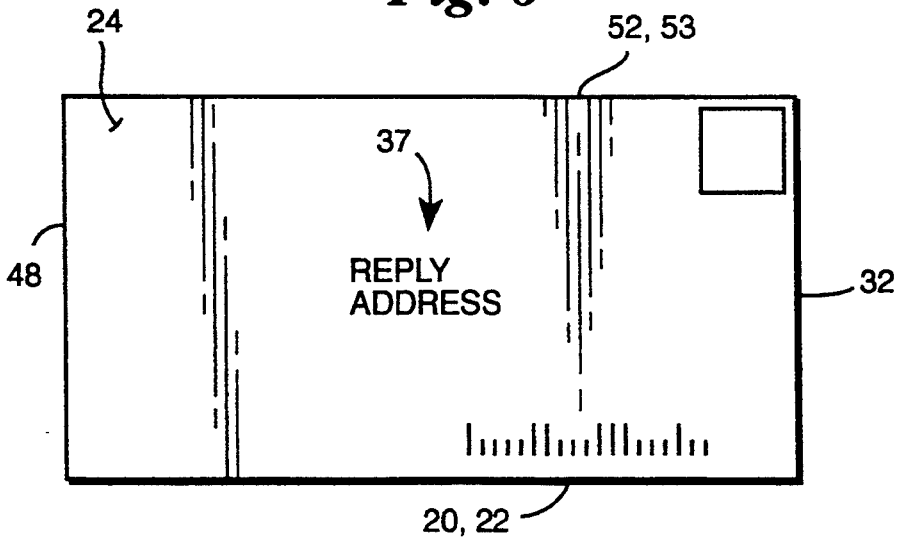
FIG. 6 is a front view of the reply envelope of FIG. 5, after the flap thereof has been folded over.

After the intermediate 11 is folded as illustrated in FIG. 3, and then passed through heat sealing equipment, it has the final mailer construction illustrated at 10 in FIG. 4. When it is desired to open the mailer 10, one tears along the perforations 48, 49, and then along the perforation 50. This produces the side opening reply envelope 28 (see FIGS. 5 and 6), but at that time with the then-edge 20 thereof still connected to the first panel 23, and the then-edge 22 thereof still connected to the fourth panel 26. Preferably the fold lines 20, 22 are perforation lines or other lines of weakness, so that the reply envelope 28 may be readily detached from the panels 23, 26. Also, the stub 36 is easily removed by detachment along the line of weakness 33, exposing the flap 34 as illustrated in FIG. 5. To use the return envelope 28, one merely inserts a check and payment stub (which may comprise all or part of the first panel 23) into the envelope 28 through the open end thereof (opposite the then-edge 48). Then the flap 34 is folded about the fold line 32, and the rewettable adhesive 35 activated and the flap 34 sealed to the third panel 25, forming the final reply envelope illustrated in FIG. 6.

Figure 7:
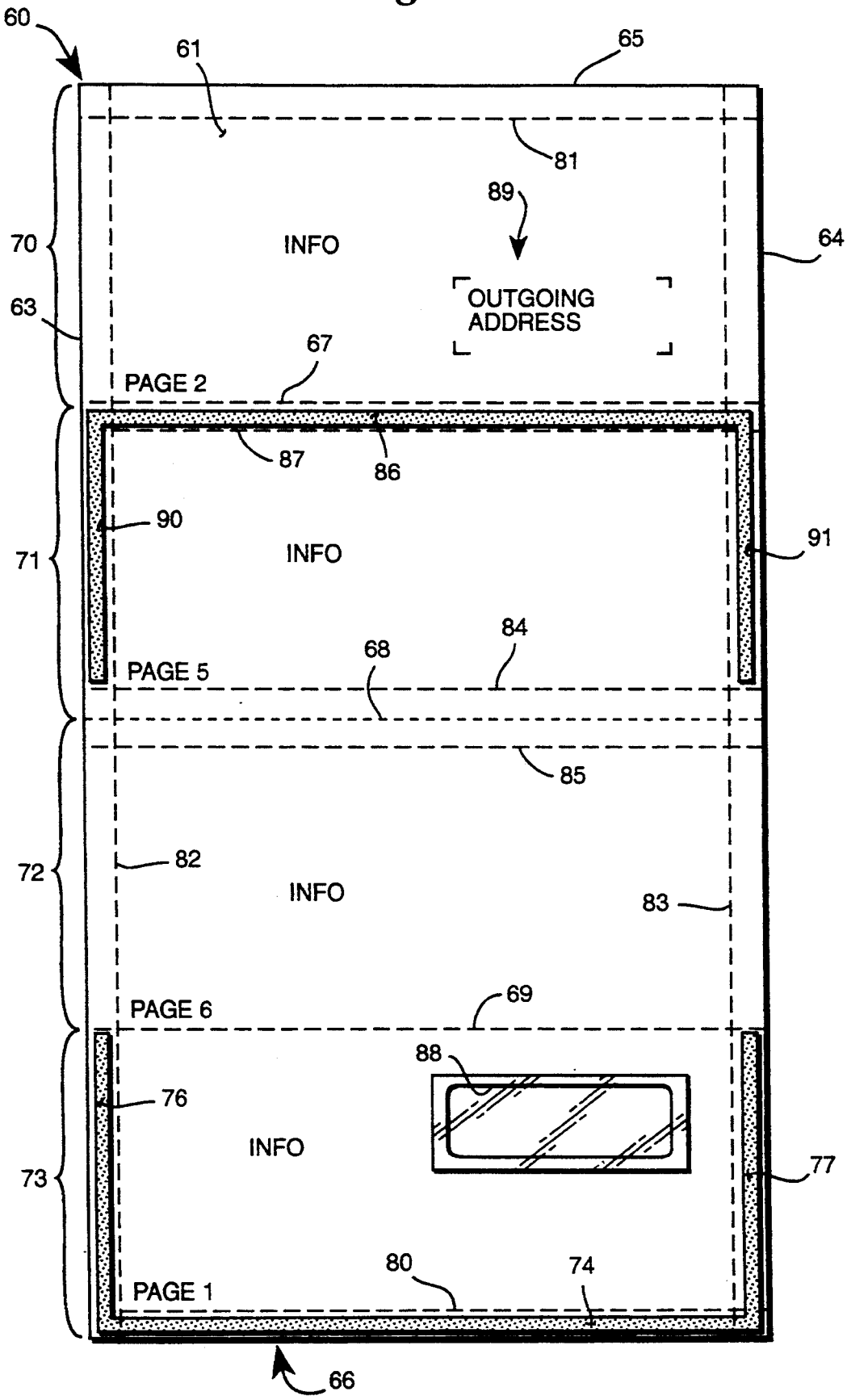
FIG. 7 is a top plan view of a second embodiment of an intermediate according to the present invention, for forming a mailer which opens into a seven page booklet.
Figure 8:
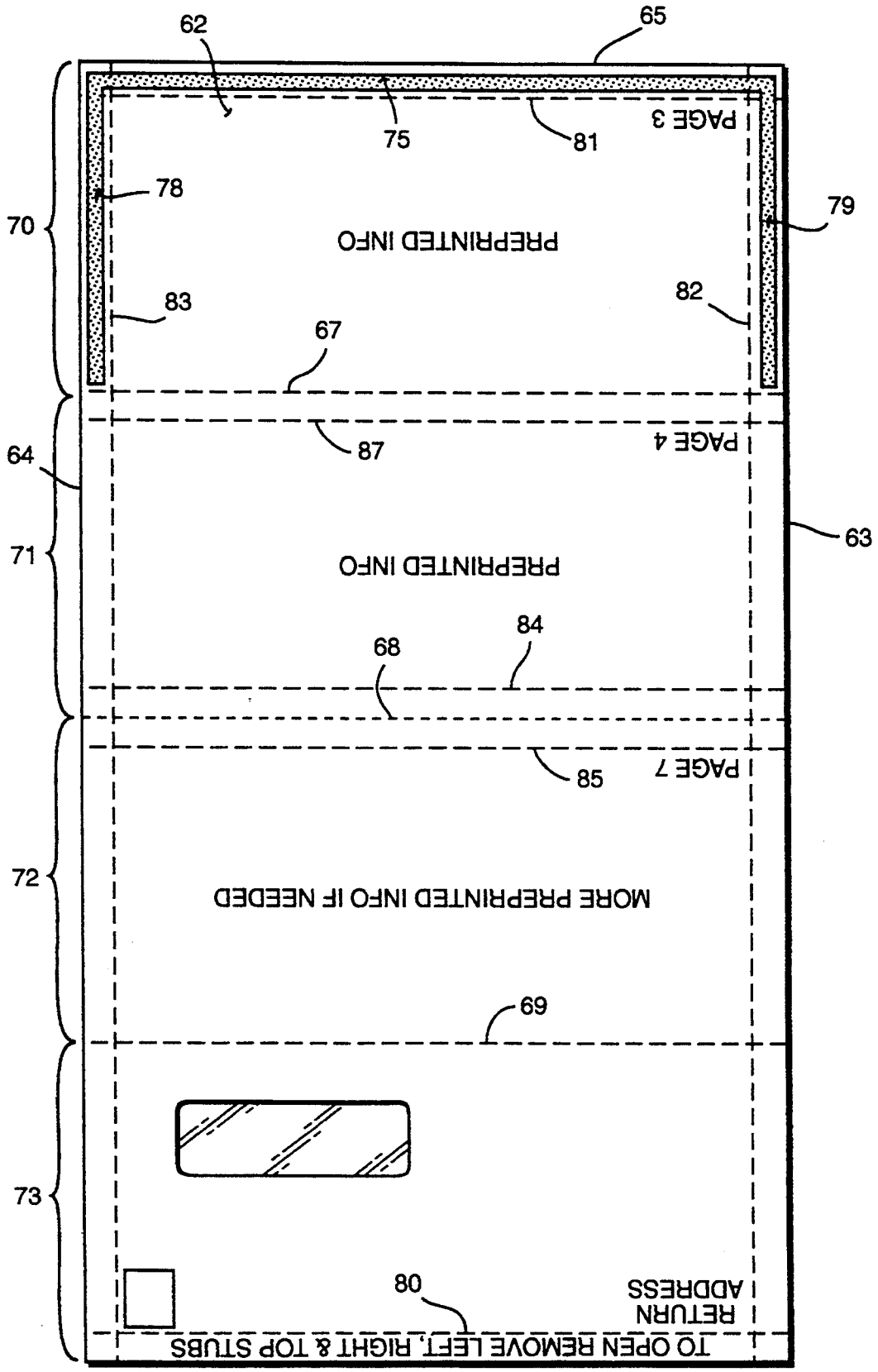
FIG. 8 is a bottom plan view of the intermediate of FIG. 7.
Figure 9:
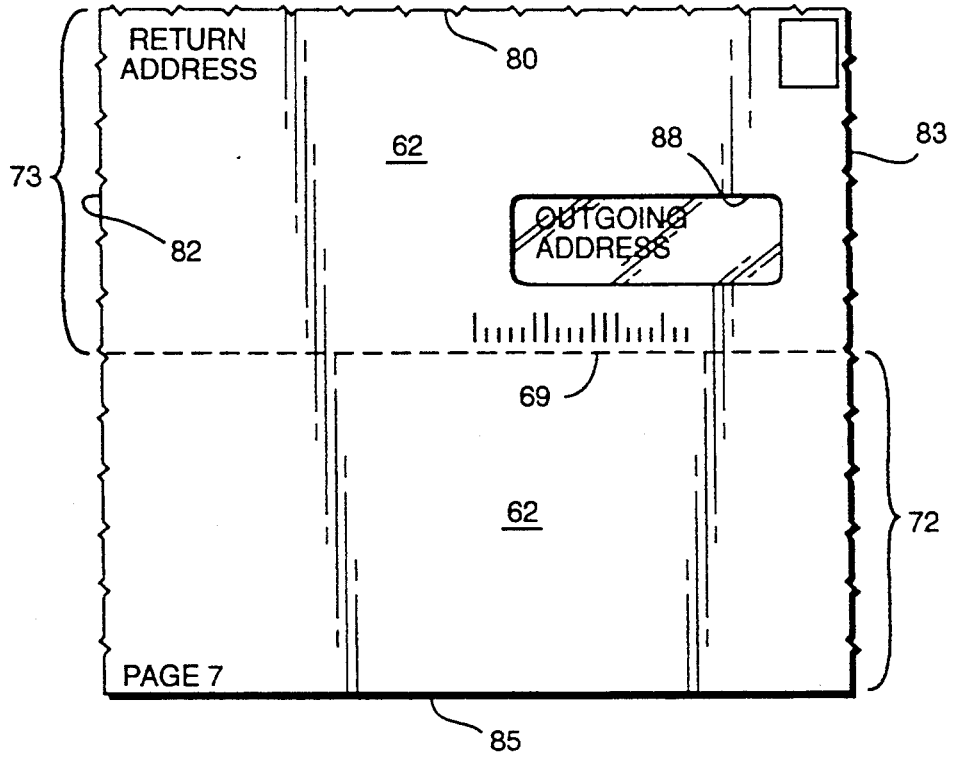
FIG. 9 is a top plan view of the mailer formed from the intermediates of FIGS. 7 and 8 after it has been opened, and laid out to show the panel faces which comprise the front and rear face of the mailer.
Figure 10:
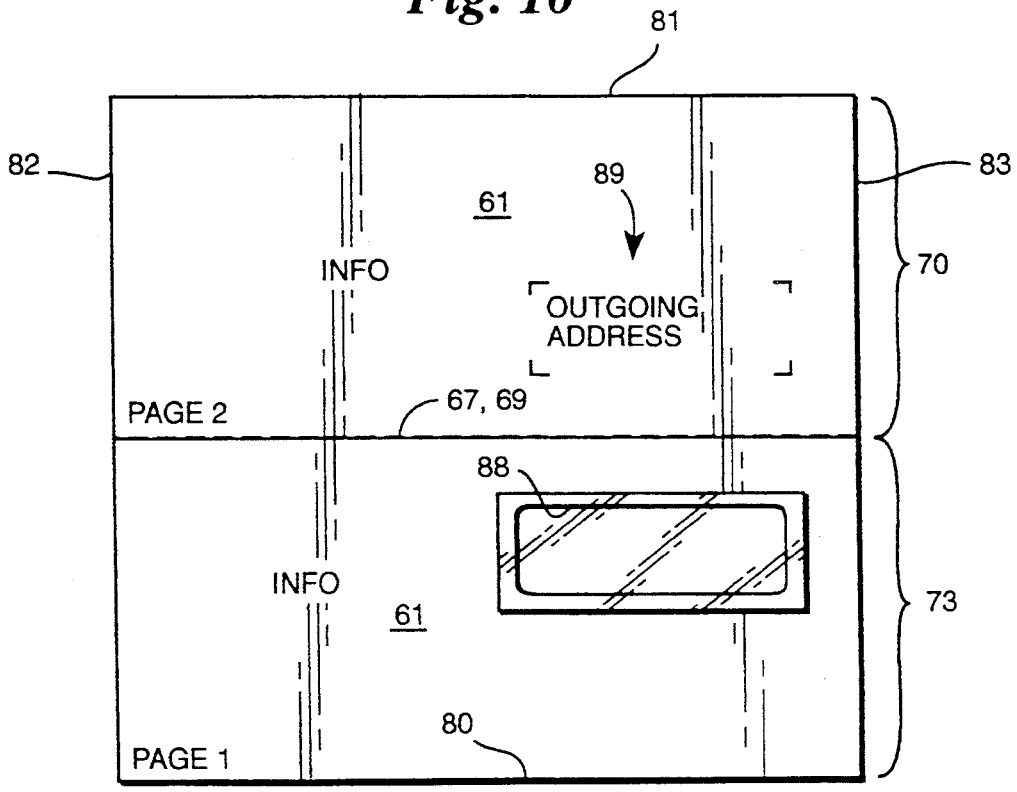
FIG. 10 is a view like that of FIG. 9 only showing the first two inside pages of the booklet formed after the mailer has been opened up.
Figure 11:
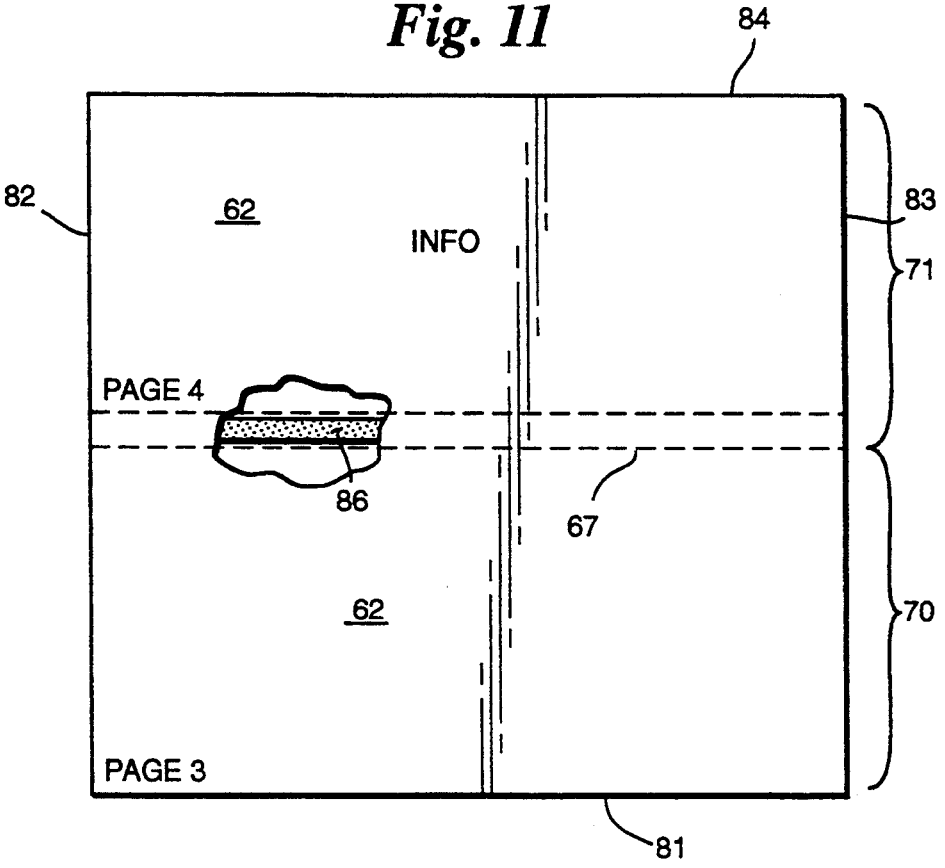
FIG. 11 is a view like that of FIG. 10 only showing the third and fourth pages of the booklet.
Figure 12:
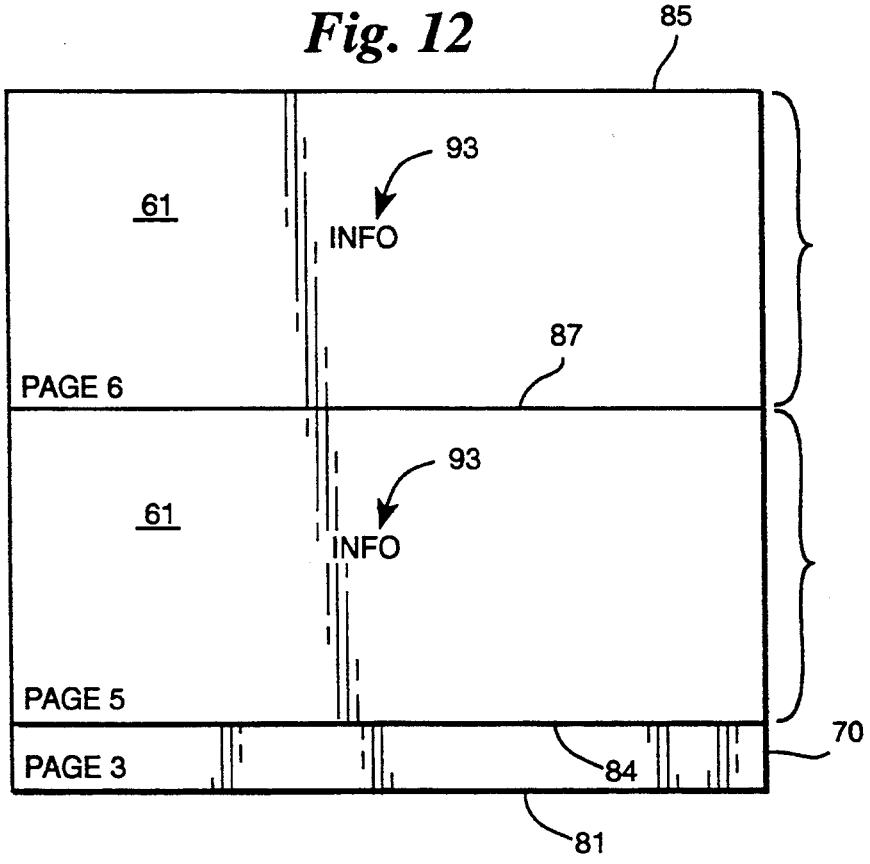
FIG. 12 is a view like that of FIG. 11 only showing the fifth and sixth pages of the booklet.

FIGS. 7 through 12 illustrate another embodiment according to the present invention. FIGS. 7 and 8 illustrate an intermediate, while FIGS. 9 through 12 illustrate the final mailer constructed from the intermediate of FIGS. 7 and 8 after it has been opened up.

The intermediate 60 of FIGS. 7 and 8 is also preferably a quadrate sheet of paper, typically 9½ by 17 inches, having first and second faces 61 (FIG. 7) and 62 (FIG. 8) respectively, first and second parallel side edges 63, 64, respectively, and first and second parallel end edges 65, 66, respectively. First, second, and third fold lines 67–69, respectively, are provided parallel to the end edges 65, 66 and define the intermediate 10 into four panels of substantially the same size. The first panel 70 is defined between the first end edge 65 and the first fold line 67, the second panel 71 is defined between the first and second fold lines 67, 68, the third panel 72 is defined between the fold lines 68, 69, and the fourth panel 73 is defined between the third fold line 69 and the second end edge 66.

The intermediate 60 when formed into a mailer opens up into a seven page booklet. For holding the mailer together prior to opening up, at least the first and second strips of adhesive 74, 75 are provided. The strip 74 is on the first face 61 of the fourth panel 73 immediately adjacent and parallel to the second edge 66 of the sheet 60, while the second strip 75 is on the second face 62 of the first panel 70, immediately adjacent and parallel to the first end edge 65. To provide a more secure hold, the side strips 76, 77 may be provided on the first face 61 of the fourth panel 73 adjacent the side edges 63, 64 (see FIG. 7), and the edge strips 78, 79 may be provided on the second face 62 of the first panel 70 adjacent the side edges 64, 63 thereof (as seen in FIG. 8). Lines of weakness are provided adjacent and parallel to the strips 74, 75 (and the strips 76–79, if present) to facilitate ready opening of the mailer formed from the intermediate 60. For example these lines of weakness may comprise the perforation line 80 adjacent the strip 74 and on the opposite side thereof from the end edge 66, the perforation 81 adjacent the strip 75 and on the opposite side thereof from the end edge 65, and the side perforations 82, 83, positioned as illustrated in FIGS. 7 and 8. In the second and third panels 71, 72, respectively, lines of weakness 84, 85 may also be provided which align with the lines of weakness 80, 81 when the intermediate 60 is double parallel folded about the fold lines 67–69.

In the FIGS. 7 and 8 embodiment, the "booklet" form of construction is effected by utilizing a strip of adhesive 86, disposed on the first face 61 of the second panel 71 (see FIG. 7) adjacent the first fold line 67. Preferably, although not necessarily, a line of weakness (perforation) 87 is provided parallel to and immediately adjacent the adhesive strip 86, on the opposite side thereof from the first fold line 67. Also, preferably all of the fold lines 67–69 are lines of weakness.

The outgoing address information can be provided in the same manner as for the FIGS. 1 through 6 embodiment. In the exemplary form illustrated in the drawings, this includes a cut out 88 formed in the fourth panel 73 in alignment—when the intermediate 60 is double parallel folded about the fold lines 67–69—with the outgoing address area 89 on the first face 61 of the first panel 70. Also, the additional adhesive strips 90, 91, may be provided on the outside of the perforation lines 82, 83, on a first face 61 of second panel 71, to further hold the mailer components together.

The intermediate 60 also preferably has page indicia thereon indicating the page numbering indicia as readily seen on the various panels 70–73 in FIGS. 7 and 8. In the exemplary form illustrated, the page indicia is provided by "page" followed by the number of the page in Arabic numeral format. However it should be understood that this page numbering is equivalent to any other page numbering such as "-1-", "p.II", etc. In the exemplary embodiment illustrated in the drawings the following indicia are provided:

| panel/face | indicia |
|---|---|
| fourth panel 73, first face 61 | page 1 |
| third panel 72, first face | page 6 |
| second panel 71, first face | page 5 |
| first panel 70, first face | page 2 |
| third panel, second face 62 | page 7 |
| second panel, second face | page 4 |
| first panel, second face | page 3. |

FIGS. 9 through 12 illustrate the final mailer produced from the intermediate 60 of FIGS. 7 and 8 after it has been opened up and laid out. A mailer is formed by first folding the sheet 60 about second fold line 68 so that the faces 61 of the panels 70, 73 and 71, 72, respectively, come in contact with each other. Then the sheet 60 is folded about the fold lines 67, 69 so that the second face 62 of second panel 71 comes in contact with the second face 62 of the first panel 70. Then the sheet 11 is passed through the heat sealing equipment (or other equipment for activating the adhesive forming the strips 74–79, 86, 90, and 91). The mailer is opened by first tearing off the left and right hand margins at the perforation lines 82, 83, and then tearing open the top at the perforation lines 80, 81, 84, and 85. The structure of FIGS. 9 through 12 results.

Note that the booklet of FIGS. 9 through 12 comprises a seven page booklet and indicia (e.g. 93) may be printed on each of the seven numbered pages in this booklet, each of the pages may be removed by tearing along a perf line, and all of the pages are bound together at only one edge (the same edge in each). Such a booklet is particularly useful for medical benefit packages or other high volume information.

Figure 13:
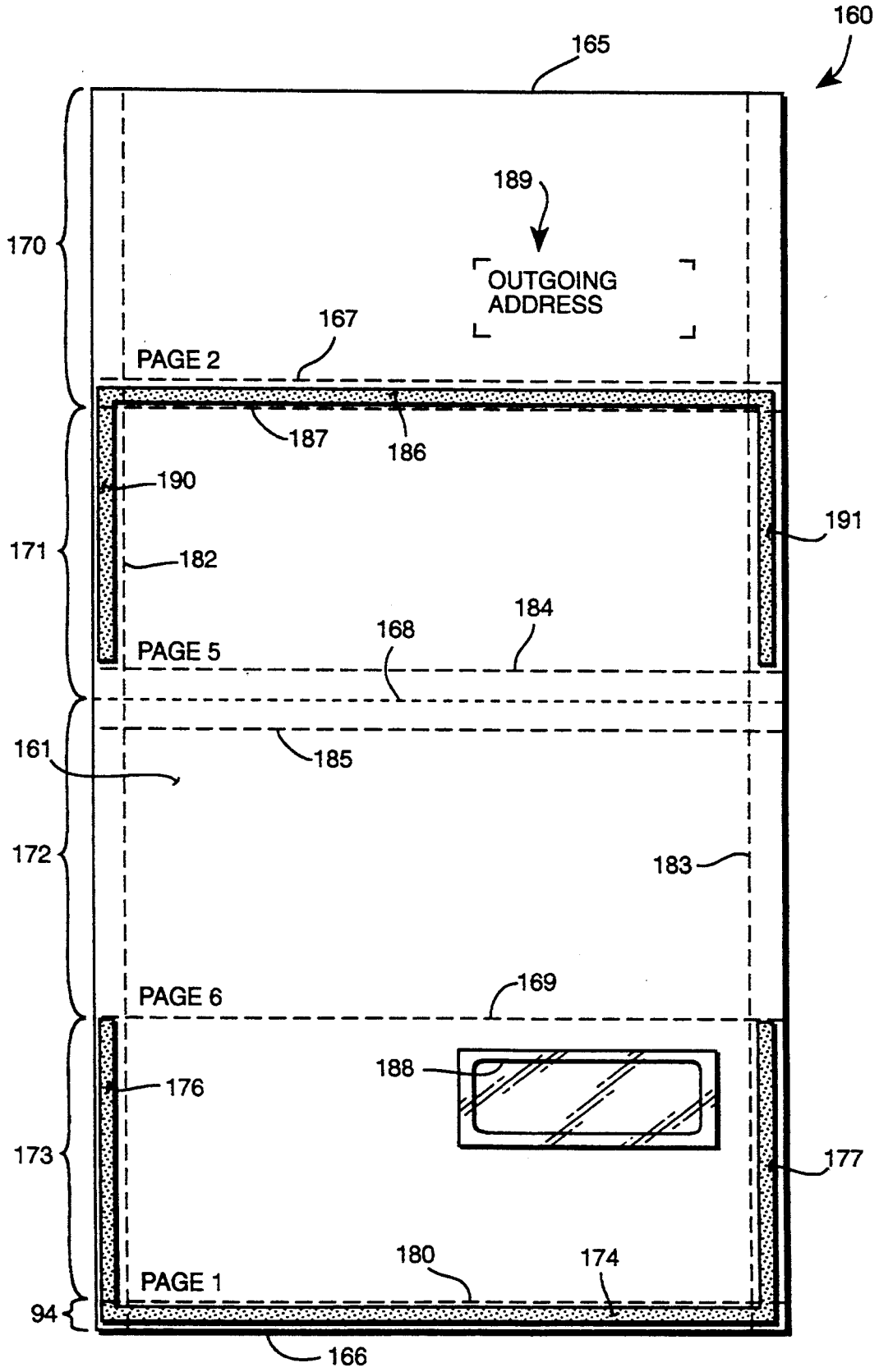
FIG. 13 is a top plan view of a third embodiment of the intermediate according to the present invention for forming a mailer by double parallel folding thereof.
Figure 14:
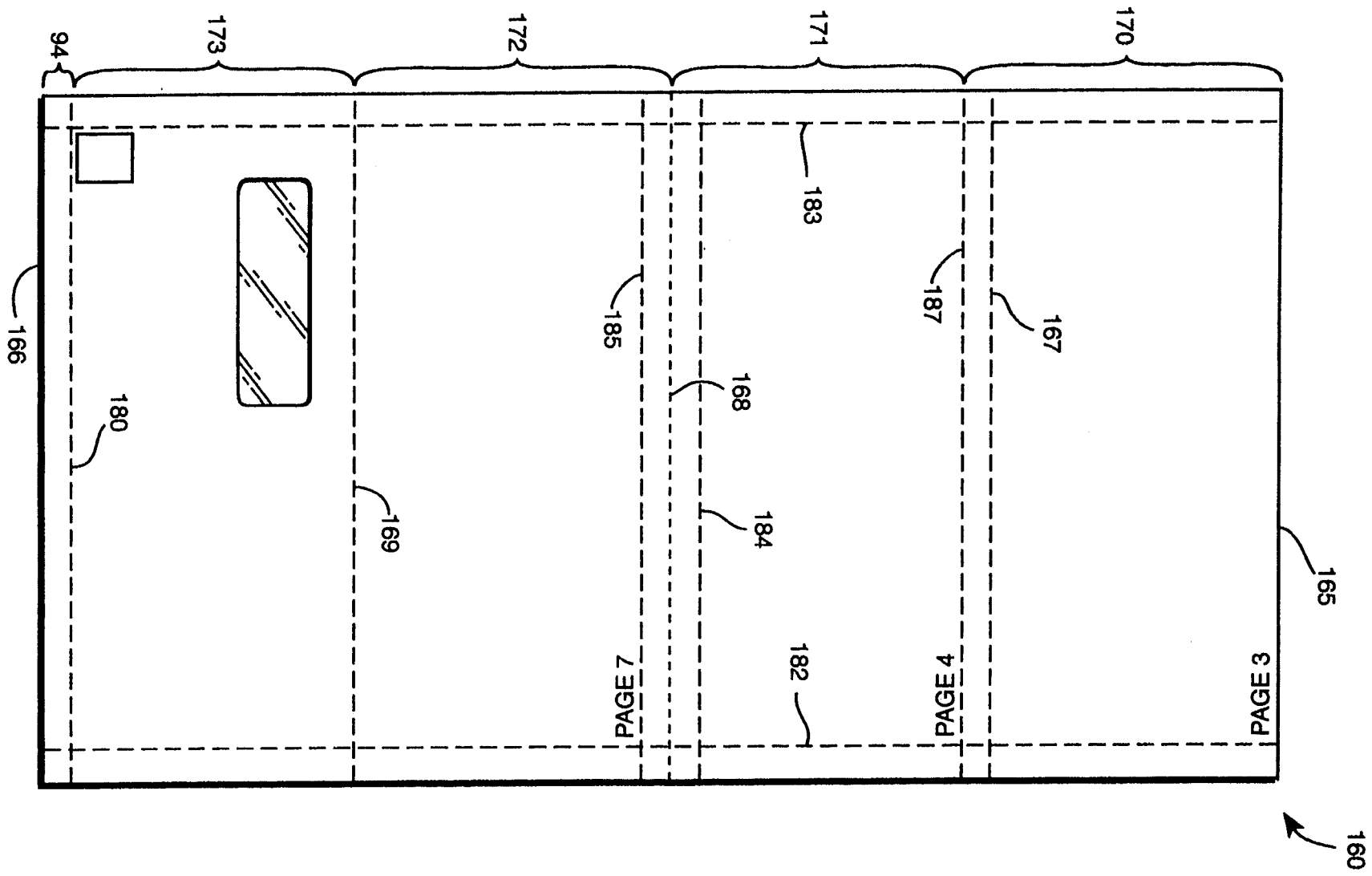
FIG. 14 is a bottom plan view of the intermediate of FIG. 13.
Figure 15:
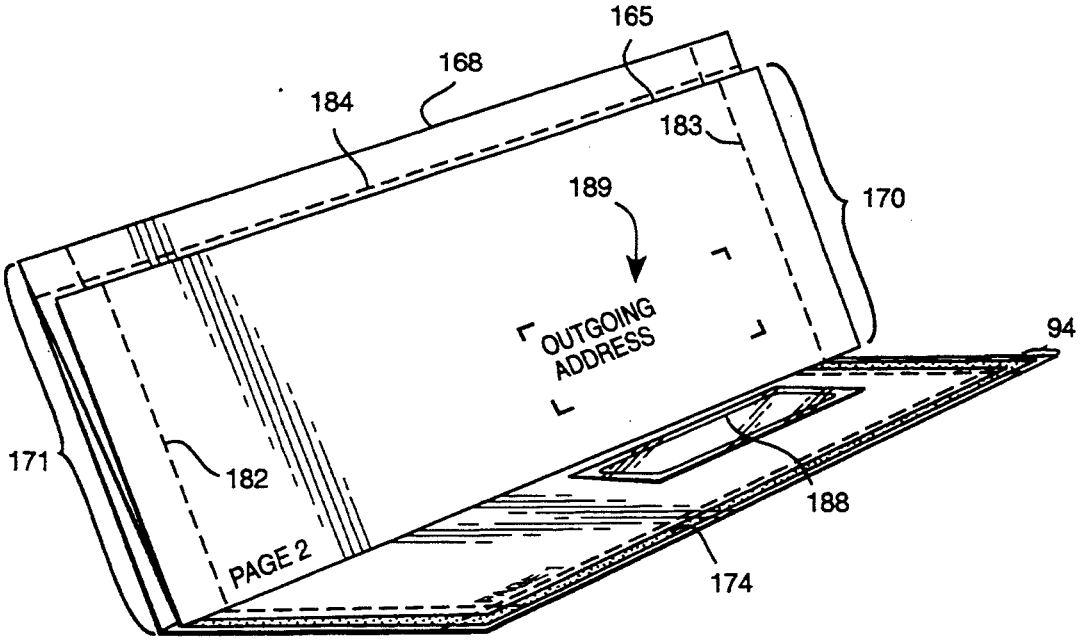
FIG. 15 is a top perspective view showing the double parallel folding of the intermediate of FIGS. 13 and 14 to produce a mailer.

FIGS. 13 through 15 illustrate another embodiment of intermediate and mailer according to the invention. This embodiment is similar to that of the embodiment of FIGS. 7 through 12. The only major distinction is in the fact that there is an eccentric double parallel folding. In the FIGS. 13 through 15 embodiment components comparable to those in the FIGS. 7 through 12 embodiment are shown by the same reference numeral only preceded by a "1".

The major distinction between the embodiment of FIGS. 13 through 15, and that of FIGS. 9–12, is that the first panel 170 has a narrower width than the other three panels 171–173. While the dimensions between the fold lines 167, 168; 168, 169; and between the fold line 169 and the bottom edge 166 are the same, the dimension between the top edge 165 and the first fold line 167 is significantly less. It is less by at least the width of the strip 94 between the perforation 180 and the second end edge 166. What this means is that when the intermediate 160 is double parallel folded about the line 168, and then the lines 167, 169, the adhesive strip 174 will engage the area of the second panel 171 between the second fold line 168 and the perforation line 184, and will not engage the first panel 170 at all. If the dimension between the edge 165 and line 167 is the same as the dimension between the line 169 and the perforation 180, then the final booklet that is constructed will still—like the FIGS. 7 through 12 embodiment—have pages of equal size.

The advantages of the construction of FIGS. 13 through 15 is the elimination of one of the glue strips (strip 75) from the FIGS. 7 through 12 embodiment, and the provision of an easier opening mailer since there are only three thickness at the top perforation where separation occurs (perfs 180, 184, 185), rather than the quadruple thickness there as in the FIGS. 7 through 12 embodiment. If desired, a reply envelope may also be nested in the mailer, as long as it is properly dimensioned so that it fits within the glue strips. (A reply envelope could also be nested in the configuration of FIGS. 7 through 12.)

Note that the concept of an eccentrically double parallel folded mailer from FIGS. 13 through 15 may also be applied to the reply envelope configuration of the FIGS. 1 through 6 embodiment.

It will thus be seen that according to the present invention an easily constructed simple mailer has been provided, which may have a side opening reply envelope, or may comprise a seven page booklet when the final mailer is opened, as well as an intermediate for the construction thereof. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent products and structures.

What is claimed is:

1. An intermediate for a mailer type business form comprising:

a quadrate single sheet of paper having first and second faces, first and second parallel side edges, and first and second parallel end edges;

first, second, and third fold lines parallel to said end edges, and dividing said sheet into first through fourth essentially equal sized panels, said first panel between said first end edge and said first fold line, said second panel between said first and second fold lines, said third panel between said second and third fold lines, and said fourth panel between said third fold line and said second end edge;

a first adhesive pattern formed on one of said second and third panels first face for cooperating with the other of said second and third panels to form a return envelope when said sheet is double parallel folded about said fold lines:

a flap fold line provided in one of said second and third panels adjacent first adhesive pattern, and parallel to said side edges, defining a fold-over flap for a return envelope formed when said sheet is double parallel folded about said fold lines;

an activatable adhesive pattern disposed on said flap first face;

a reply address area provided on the second face of one of said second or third panels;

a second adhesive pattern formed on said first face of said fourth panel, and a third adhesive pattern formed on said second face of said first panel for holding said panels together when said sheet is double parallel folded about said fold lines; and lines of weakness formed in said panels adjacent, said second and third adhesive patterns for allowing detachment of said sheet thereat to allow opening of a mailer formed by double parallel folding said sheet about said fold lines.

2. An intermediate as recited in claim 1 further comprising an outgoing address area provided on said first panel first face, and a window in said fourth panel, said window in alignment with said outgoing address area when said sheet is folded about said fold lines to form a mailer.

3. An intermediate as recited in claim 1 wherein said first adhesive pattern comprises a generally U-shaped pattern comprises three strips, first and second strips adjacent and parallel to two of said fold lines, and a third strip adjacent and parallel to the side edge on the opposite side of said sheet from said flap.

4. An intermediate as recited in claim 1 further comprising a fourth adhesive pattern comprising a pair of strips provided on said first face adjacent said first and second side edges, respectively, on one of said second and third panels; and lines of weakness on the opposite side of said fourth adhesive pattern strips from said respective side edges.

5. An intermediate as recited in claim 4 wherein said first through fourth adhesive patterns are strips of heat activated adhesive, and wherein said activatable adhesive pattern on said flap is rewettable adhesive, and wherein said sheet is about 9½ by 17 inches.

6. An intermediate as recited in claim 1 further comprising a line of weakness comprising an extension of said flap fold line and formed in the one of said second and third panels in which said flap fold line is not formed.

7. A mailer type business form comprising:

first, second, third and fourth substantially quadrate panels, each having essentially the same size, first and second side edges,and first and second end edges, and top and bottom faces, and said first panel underlying said fourth panel, and said second panel underlying said first panel, and said third panel underlying said second panel;

a first adhesive pattern comprising first and second strips of adhesive parallel to and adjacent, but spaced from, said end edges, and a third strip of adhesive parallel to and adjacent, but spaced from, said first side edge, said strips acting between said second panel top face and said third panel bottom face to define a reply envelope;

a flap fold line formed in said second panel, and a stub-forming line of weakness formed in said third panel, said flap fold line and said stub-forming line of weakness in alignment with each other and adjacent, but spaced from, and parallel to, said second side edge, said flap fold line forming a reply envelope flap;

a strip of activatable adhesive provided on the face of said flap facing said third panel;

reply address indicia provided on said reply envelope;

second and third adhesive patterns holding said first panel to said fourth panel adjacent at least one edge thereof, and for holding said first panel to said second panel adjacent at least one end edge thereof; and lines of weakness formed in at least said first, fourth and second panels adjacent said second and third adhesive patterns on the opposite sides thereof from said adjacent end edges, to facilitate opening of said mailer.

8. A mailer as recited in claim 7 further comprising a cutout in said fourth panel, and outgoing address indicia provided on said first panel top face, underlying and in alignment with said cutout.

9. A mailer as recited in claim 7 wherein said reply address indicia is provided on said top face of said second panel.

10. A mailer as recited in claim 7 wherein said second and third adhesive patterns also comprise portions parallel to and adjacent said side edges for holding said first panel to said fourth panel, and said first panel to said second panel; and a fourth adhesive pattern parallel to said side edges and adjacent thereto, for holding said second and third panels together adjacent said side edges; and lines of weakness formed in said first through fourth panels parallel to said side edges and on the opposite sides of said side edges from said second, third, and fourth adhesive pattern portions and parallel to said side edges, said lines of weakness facilitating opening of said mailer.

11. A mailer type business form comprising:

first, second, third and fourth substantially quadrate panels, each having essentially the same size, first and second side edges, and first and second end edges, and top and bottom faces, and said first panel underlying said fourth panel, and said second panel underlying said first panel, and said third panel underlying said second panel;

a first adhesive pattern comprising first and second strips of adhesive parallel to and adjacent, but spaced from, said end edges, and a third strip of adhesive parallel to and adjacent, but spaced from, said first side edge, said strips acting between said second panel top face and said third panel bottom face to define a reply envelope;

a flap fold line formed in said third panel, and a stub-forming line of weakness formed in said second panel, said flap fold line and said stub-forming line of weakness in alignment with each other and adjacent, but spaced from, and parallel to, said second side edge, said flap fold line forming a reply envelope flap;

a strip of activatable adhesive provided on the face of said flap facing said second panel;

reply address indicia provided on said reply envelope;

second and third adhesive patterns holding said first panel to said fourth panel adjacent at least one end edge thereof, and for holding said first panel to said second panel adjacent at least one end edge thereof; and lines of weakness formed in at least said first, fourth and second panels adjacent said second and third adhesive patterns on the opposite sides thereof from said adjacent end edges, to facilitate opening of said mailer.

12. A mailer as recited in claim 11 further comprising a cutout in said fourth panel, and outgoing address indicia provided on said first panel top face, underlying and in alignment with said cutout.

13. A mailer as recited in claim 11 wherein said reply address indicia is provided on said top face of said second panel.

14. A mailer as recited in claim 11 wherein said second and third adhesive patterns also comprise portions parallel to and adjacent said side edges for holding said first panel to said fourth panel, and said first panel to said second panel; and a fourth adhesive pattern parallel to said side edges and adjacent thereto, for holding said second and third panels together adjacent said side edges; and lines of weakness formed in said first through fourth panels parallel to said side edges and on the opposite sides of said side edges from said second, third, and fourth adhesive pattern portions and parallel to said side edges, said lines of weakness facilitating opening of said mailer.

* * * * *